United States Patent [19]

Bowen et al.

[11] Patent Number: 5,011,069

[45] Date of Patent: -Apr. 30, 1991

[54] CONTINUOUS MAILER ASSEMBLY

[75] Inventors: Charles G. Bowen, La Grangeville; Anthony B. Dolce, Pleasant Valley, both of N.Y.

[73] Assignee: Transkrit Corporation, Brewster, N.Y.

[21] Appl. No.: 545,340

[22] Filed: Jun. 26, 1990

[51] Int. Cl.[5] ..... B65D 27/06; B65D 27/10

[52] U.S. Cl. ..... 229/69; 229/73

[58] Field of Search ..... 229/69, 73

[56] References Cited

U.S. PATENT DOCUMENTS

| | | | |
|---|---|---|---|
| 3,411,699 | 11/1968 | Pine et al. | 229/73 |
| 3,428,237 | 2/1969 | Dowen | 229/69 |
| 3,952,942 | 4/1976 | O'Leary et al. | 229/69 |
| 4,384,670 | 5/1983 | Dicker | 229/73 |
| 4,706,877 | 11/1987 | Jenkins | 229/69 |
| 4,715,530 | 12/1987 | Leese et al. | 229/69 |
| 4,779,792 | 10/1988 | Lombardo | 229/69 |
| 4,923,112 | 5/1990 | Dale | 229/69 |

*Primary Examiner*—Stephen P. Garbe

*Attorney, Agent, or Firm*—Kenyon & Kenyon

[57] ABSTRACT

A mailer unit having front and back plies secured together on three sides to form an open-ended pocket, a removable insert ply within the pocket, a cover ply removably secured to the front ply and having an image transfer coating for imprinting a reply address on the front ply under the cover ply.

17 Claims, 4 Drawing Sheets

Fig. 8.
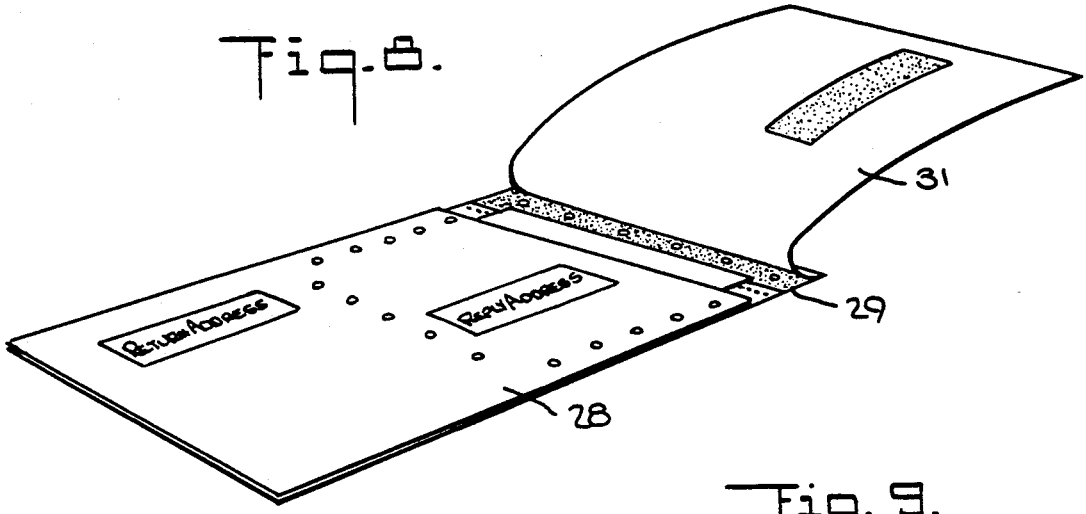
Fig. 9.
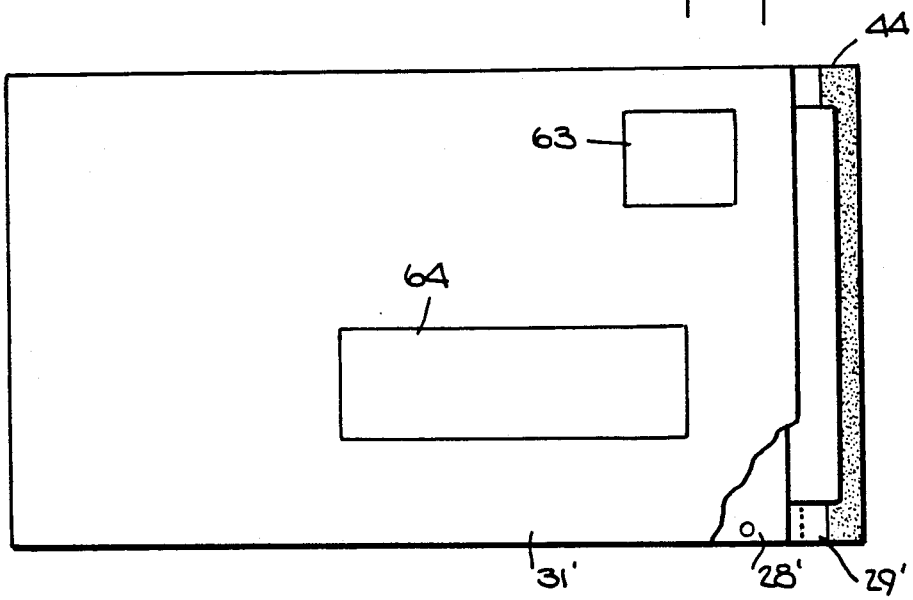
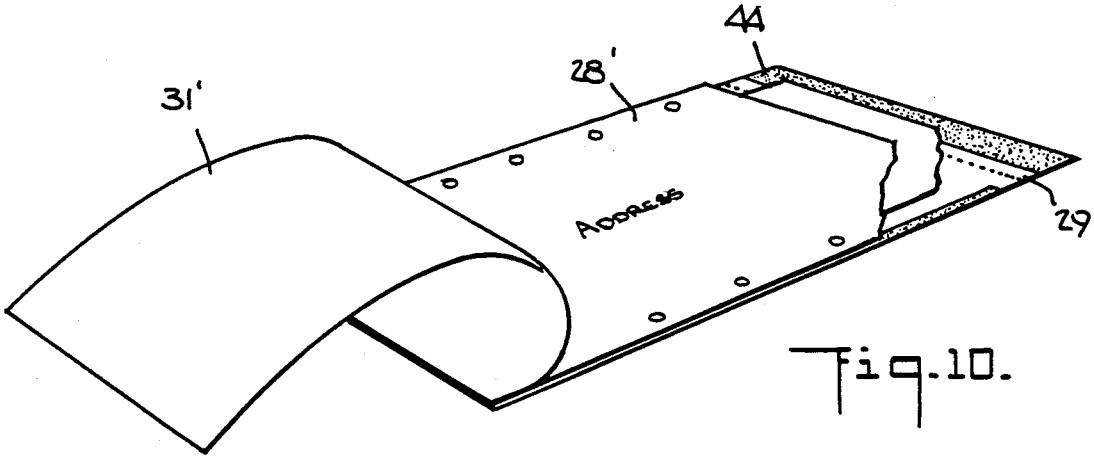
Fig. 10.

CONTINUOUS MAILER ASSEMBLY

This invention relates to a continuous mailer assembly.

Heretofore, various types of continuous mailer assemblies have been known wherein a stream of mailer units are interconnected so as to be processed through automated equipment in a sequential manner, for example as described in U.S. Pat. No. 4,418,865. In many cases, such continuous mailer assemblies have been provided with an overlying ply which can be readily removed after processing so as to be retained for accounting purposes and the like while the stream of mailer units is then separated into individual mailers (mailer units) for mailing purposes.

Generally, the mailer units have been constructed to provide not only an envelope for mailing information to an addressee but also a reusable reply envelope by means of which the addressee can return information, such as a check in payment for an invoice, to the original sender or another. However, in many cases, postal authorities have objected to the format in which the mailers are sent through the mails. Specifically, in many cases, the mailers have been provided with a reply address which can be readily confused with the address of the addressee. In some cases, this has resulted in the mailer being mailed to the reply address rather than the intended addressee because the reply address is read rather than the addressee address.

In order to avoid the above situation, it has been known to provide return mailer constructions with an extra ply of paper to form a cover ply which extends over a portion of the front face of the mailer to cover over approximately one half of the front face of the mailer unit. In such cases, the cover ply is provided with the address of the intended addressee while the covered over surface of the front ply is provided with a preprinted address for the reply envelope. In such cases, the mailer unit would not have both addressee and reply addresses which might be otherwise confusing to postal authorities However, the use of a cover ply over the face of the mailer unit requires the reply address and/or postal indicia to be printed on the underlying ply in the area to be covered by the flap prior to assemblage of the mailer unit.

Accordingly, it is an object of the invention to economically generate a continuous mailer assembly capable of being printed after assemblage with reply address information.

It is another object of the invention to provide a mailer unit containing a reusable envelope construction which can be readily processed by postal authorities.

It is another object of the invention to provide a mailer unit which can be rapidly and efficiently handled by postal authorities.

Briefly, the invention provides a mailer unit which comprises a front ply of predetermined width, a back ply secured to the front ply on three sides to define an open-ended pocket therewith and at least one removable insert ply within the pocket between the front and back plies and with an area underlying the front ply in order to receive imprinted information thereon by carbon or chemical transfer or other suitable image transfer means.

In addition, the mailer unit includes a fourth ply (cover ply) which is removably secured in overlying relation to a portion of the front ply. This fourth ply also has a front surface to receive an outgoing address and an area for receiving postal indicia as well as an image transfer means for imprinting a reply address on the covered over portion of the front ply. The image transfer means, such as a carbon area on a back surface, permits a reply address to be imprinted on the front ply, for example during processing through automated equipment with a series of interconnected mailer units. Other suitable means of image transfer, such as chemicals, may be substituted for the carbon, and may be placed on the face of the front ply rather than the back of the cover ply. Image transfer may also be accomplished by an interaction between parts as with coated back/coated face carbonless chemical imaging.

In one embodiment, the fourth ply has an edge strip adhesively secured to the front ply and a perforation for separating the strip from the remainder of the fourth ply. In this embodiment, upon receipt by an addressee, the fourth ply can be removed from the remainder of the mailer unit so as to expose the contents of the pocket between the front ply and back ply. The insert ply or plies can then be removed and the remaining plies utilized as a reusable reply envelope. To this end, as is known, the back ply is provided with a flap for overlying the front ply with this flap being provided with a suitable adhesive for sealing against the front surface of the front ply.

The mailer unit is such as to eliminate a misdirecting of mail by postal authorities. As constructed, a postal worker can see only the outgoing address on the mailer unit so that the unit cannot be misdirected. Likewise, when the mailer unit is opened, the outgoing address (and the postal coding for the address) is eliminated and the mailer can only be directed to the reply address - the only remaining mailing address. The post office can now add coding to represent the new address.

In another embodiment, the fourth ply (cover ply) can be secured by glue dots to the front ply and back ply of the mailer unit. In this embodiment, when the fourth ply is removed, no strip remains on the reusable envelope.

In still another embodiment, the mailer unit may be constructed with a cover ply which extends substantially across the entire width of the mailer unit. For example, the cover ply may be secured on one side directly to the front ply while being secured, as by glue dots, on the opposite side to the back ply of the mailer unit. Alternatively, the cover ply may be secured only to the front ply so that the insert ply or plies are exposed to view at one side.

The invention also provides a mailer assembly composed of a plurality of interconnected mailer units as well as an overlying web which is separated, as by perforations, into individual sections overlying each mailer unit. In this case, each section serves as a ply of predetermined width having a plurality of data-entry fields on a front surface. In addition, a plurality of image transfer areas, such as carbon areas, may be provided on a back surface with the carbon areas aligned with selected data entry fields.

By way of example, each ply which overlies a mailer unit may have six data entry fields on the front surface and three carbon areas on the back surface.

One data-entry field may be a "postal indicia" field aligned with a respective carbon area for imprinting postal information onto the front of the underlying removable cover ply of a mailer unit. Likewise, an "outgoing address" field may be aligned with a respective carbon area for imprinting an outgoing address on the removable cover ply of the mailer unit while a "return address" field is aligned with a respective carbon area for imprinting a return address on the front ply or the mailer unit.

In addition, one data-entry field may include a "reply address" field aligned with a carbon area of the removable cover ply of the mailer unit for imprinting of a reply address on the front ply of a mailer unit through and under the removable cover ply.

In addition, the data-entry fields may include a "message area" aligned with a carbon area on the back of the front ply for imprinting a message on the insert ply while a "message area return portion" field is aligned with another portion of the carbon area on the back of the front ply for imprinting a return message on the insert ply.

The continuous mailer may be passed through automated processing equipment for the printing of information onto the overlying ply and the mailer units in one sequence. The overlying ply may then be removed and used as a control form, for example for accounting purposes. The remaining mailer units can then be separated and mailed through the usual postal channels.

The continuous mailer may also be constructed such that the overlying ply may be of less width than the front ply. For example, the overlying ply may have a pinhole control strip on only one side and may not extend over the entire width of the mailer.

The continuous mailer assembly also includes suitable means for releasably securing the overlying ply to a respective mailer unit for processing purposes. For example, use may be made of pairs of pin hole control strips removably secured to opposite sides of each of the overlying ply and the plies of the mailer units with interdigitated tabs in the control strips for holding the strips together.

These and other objects and advantages of the invention will become more apparent from the following detailed description taken in conjunction with the accompanying drawings wherein:

FIG. 8 illustrates a view of a modified mailer unit having a cover sheet secured by glue spots to the front and back plies in accordance with the invention;

FIG. 9 illustrates a front view of a further modified mailer unit in accordance with the invention; and FIG. 10 illustrates a view of the mailer unit of FIG. 9 during removal of the cover ply.

The mailer units are initially fabricated in continuous mailer assembly form, that is, with multiple plies of papers or the like which are disposed in overlying relation to each other, for example as described in U.S. Pat. Nos. 4,418,865 and 4,157,759. In this respect, since the technique for generating webs of paper and perforating the webs into individual units is well known, no further description is believed to be necessary in this respect.

It is to be understood that any suitable technique for fabricating continuous mailers may be used with the mailer assembly described hereinafter.

Figure 1:
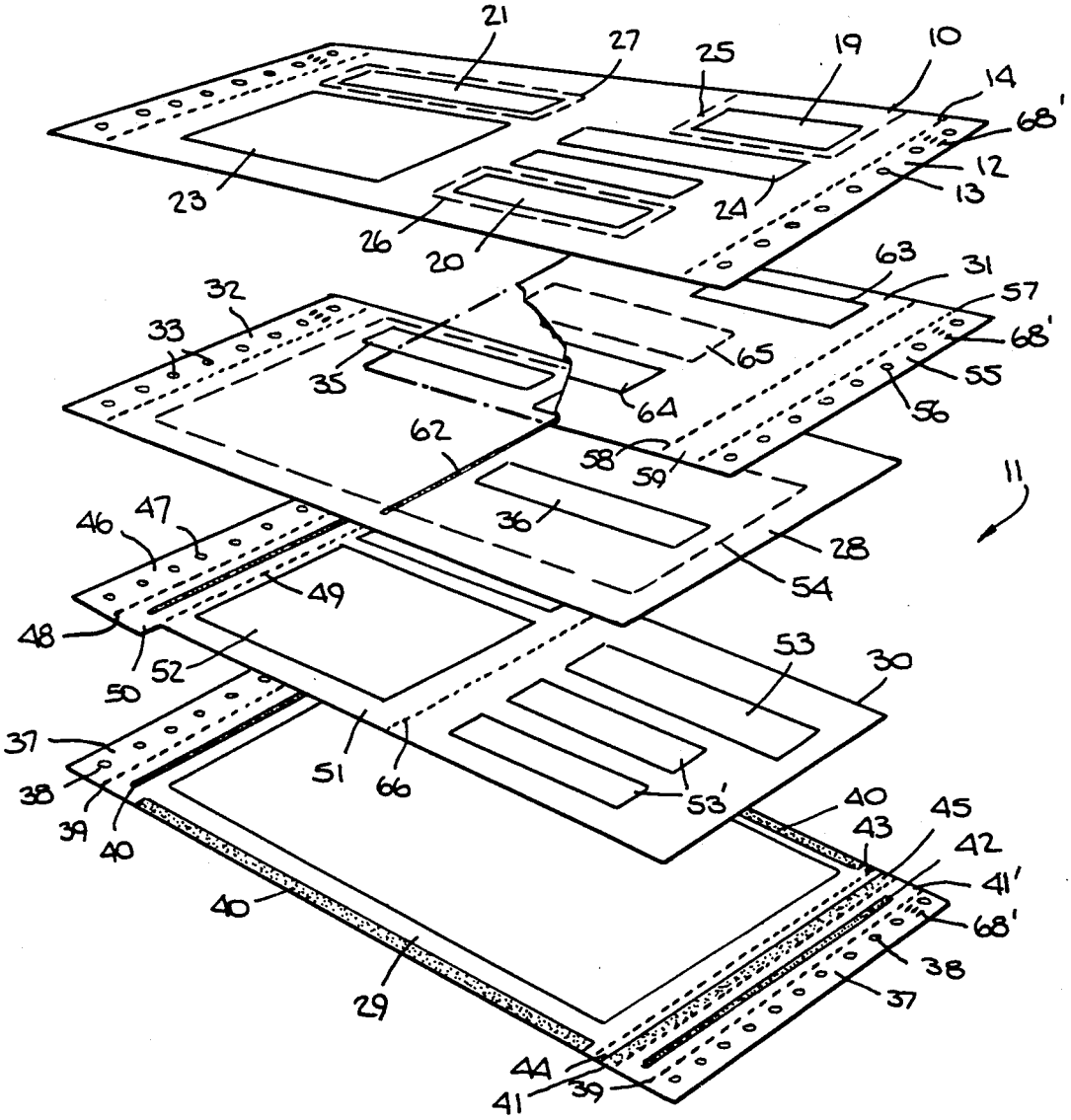
FIG. 1 illustrates an exploded view of a mailer unit and overlying ply in accordance with the invention.

Referring to FIG. 1, each unit of a continuous mailer is composed of an overlying ply 10 and a multiple-ply mailer unit 11.

Figure 2:
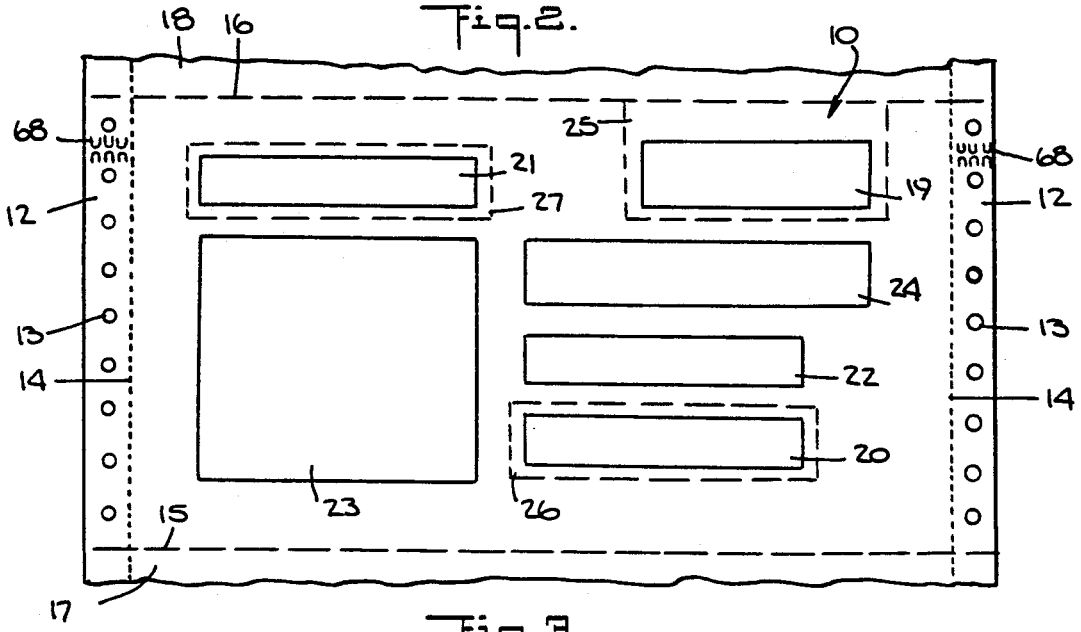
FIG. 2 illustrates a front view of a ply containing data-entry fields in accordance with the invention.

Referring to FIGS. 1 and 2, the overlying ply 10 is made of paper or any other suitable material. In addition, the ply 10 is of rectangular shape and includes a pair of removable strips 12 at the opposite marginal edges, each of which is provided with control line holes 13. These strips 12 may be separated from the remainder of the ply by longitudinal lines of weakening 14 as is known. As indicated in FIG. 2, each ply 10 is interconnected via a transverse line of weakening 15, 16 from an adjacent like ply 17, 18 of a continuous web.

Referring to FIG. 1, the ply 10 is provided with six data-entry fields 19–24 on the front and image transfer means, e.g., three carbon areas 25–27 on the back surface in alignment with respective data-entry fields 19, 20, 21. While the image transfer means is described in terms of a carbon area on the underside of a ply, it is to be noted that any other suitable image transfer means may be used. For example, use may be made of spots of micro encapsulated chemicals on the front face of a ply. Such image transfer means are well known and need not be further described. For example, upon impact of an instrument against such spots, the microcapsules are ruptured so that an image can be formed on the face of the ply. As illustrated, each data-entry field 19–24 is of rectangular shape; however, any other suitable shape may be used.

Of note, the ply 10 may be preprinted or coded for the designation of the data-entry fields 19–24. Alternatively no visible indicia need be provided on the ply 10, for example in instances where an automated printer is programmed to insert information in predetermined areas of the ply 10.

Referring to FIG. 1, each mailer unit 11 is composed of, for example, four plies, namely a front ply 28, back ply 29, insert ply 30 and cover ply 31.

Figure 4:
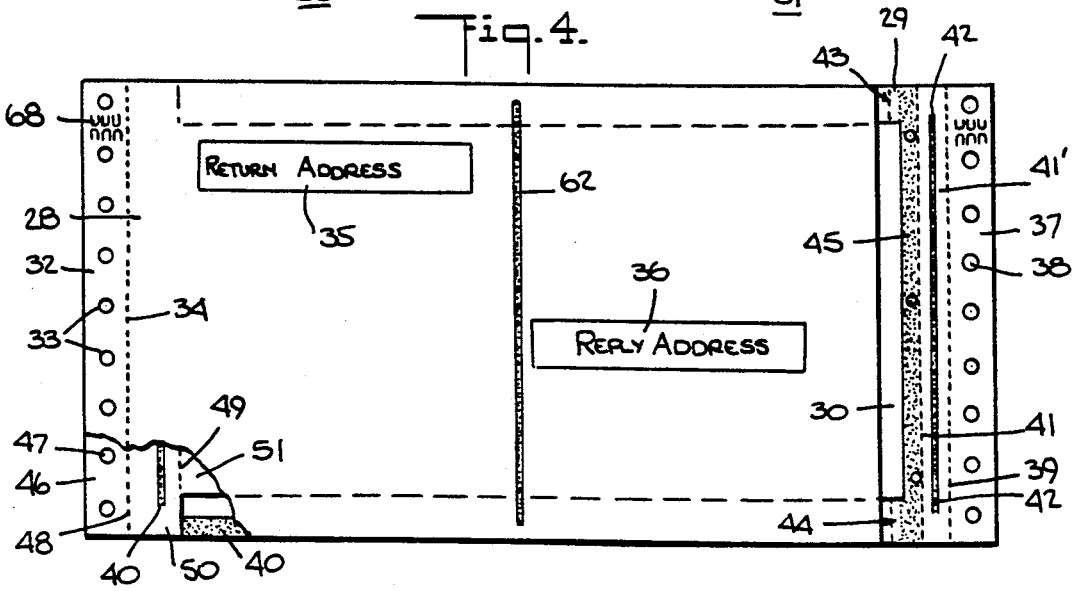
FIG. 4 illustrates the mailer unit of FIG. 3 with the cover ply removed.

Referring to FIGS. 1 and 4, the front ply 28 is of rectangular construction and is of a width less than the width of an overlying ply 10 and of the same height as the overlying ply 10. As indicated, the front ply 28 includes a control strip 32 with line holes 33 and may have a perforation 34 for separating the control strip 32 from the remainder of the ply 28. This front ply 28 is provided with one location or designated area 35 to receive a return address and a second location 36 to receive a reply address.

Referring to FIGS. 1 and 4, the back ply 29 is provided with control strips 37 at each opposite side with each strip 37 having control holes 38 as above. A line of weakening (perforations) 39 may separate each strip 37 from the remainder of the ply 29. As indicated, the back ply 29 is of the same width as the overlying ply 10 and, thus, is of greater width than the top ply 28.

The front ply 28 and back ply 29 are secured together along three sides by suitable means such as lines of adhesive 40 in order to form an open-ended pocket which opens to the side. Together, the front ply 28 and back ply 29 form a reusable return envelope.

As illustrated in FIG. 1, the back ply 29 is provided with three lines of adhesive 40 in a U-shaped pattern for securement to the front ply 28. In addition, the back ply 29 has a second longitudinal line of weakening, such as perforations, 41 parallel to the control strip 37 to define a strip 41' therebetween and a line of adhesive 42 on the strip 41' between the two lines of weakening 39, 41 for securement of the cover ply 31 to the back ply 29.

In addition, the back ply 29 may have a third line of weakening 43 parallel to the line of weakening 41 to define a fold-over flap 44 therebetween. The flap 44 may also be provided with a line or blocks of remoistenable glue 45, pressure sensitive tape or other suitable form of adhesive. In this way, the fold-over flap 44 may be sealed over the top ply 28 as described below with respect to FIG. 7.

Referring to FIG. 1, the insert ply 30 may be provided with a control strip 46 with control holes 47 on only one side. In addition, a line of weakening such as a line of perforations 48 separates the control strip 46 from the remainder of the ply 30.

As indicated, the insert ply 30 may also have a second line of weakening 49 parallel to the first line of weakening 48 so as to define a securement strip 50 therebetween. This strip 50 may be provided with glue on opposite sides for securing to the top and bottom plies 28, 29, as is known. A remaining portion 51 of the insert ply 30 may then be removed along the interior line of weakening 49 so as to be removed from between the front and back plies 28, 29 in known fashion. As shown in FIG. 4, the insert ply 30 projects slightly beyond the front ply 28 for removal purposes.

As illustrated in FIG. 1, the insert ply 30 may be provided with various designated areas 52, 53 to receive information. To this end, the back surface of the front ply 28 is provided with an enlarged carbon area 54 so as to transfer information onto the designated areas 52, 53 of the insert ply 30.

Figure 3:
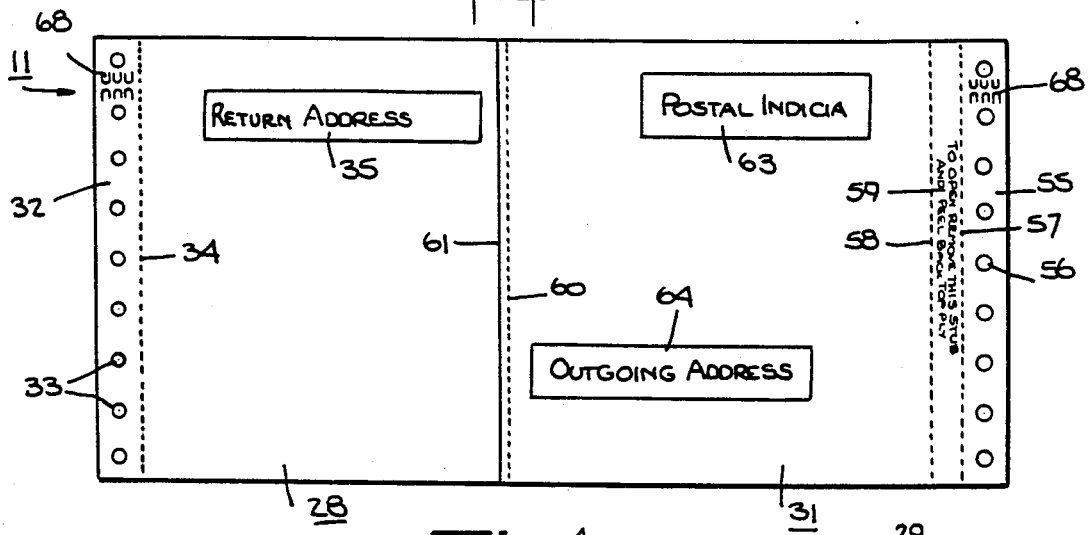
FIG. 3 illustrates a front face of a mailer unit including the cover ply constructed in accordance with the invention.

Referring to FIGS. 1 and 3, the cover ply 31 is of less width than the front ply 28 and has a control strip 55 on only one side provided with control holes 56. In addition, a line of perforations 57 separates the strip 55 from the remainder of the cover ply 31. The cover ply 31 also includes a second line of weakening such as a line of perforations 58 parallel to the control strip 55 to form a strip 59 between the lines of perforations 57, 58. This strip 59 is positioned so as to adhere to the line of glue 42 on the back ply 29. In this way, the cover ply 31 is secured along at least one side to the back ply 29. The opposite side of the cover ply 31 is provided with a line of weakening 60 such as a line of perforations spaced inwardly of the edge of the ply so as to define a strip 61 which can be secured by a line of adhesive or the like 62 to the face of the front ply 28.

As illustrated in FIG. 3, the cover ply 31 is provided with two designated areas 63, 64 one of which is to receive postal indicia while the other is to receive an outgoing address. In addition, the back surface of the cover ply 31 is provided with a carbon area 65 (see FIG. 1) for imprinting a reply address on the covered over portion of the front ply 28.

Referring to FIG. 2 and 3, the data entry fields 1924 24 and the carbon areas 25–27 are positioned for the printing of information on the various plies of the mailer unit 11. For example, the postal indicia field 19 is aligned with the carbon area 25 for imprinting postal information onto the front face of the cover ply 31. In addition, the outgoing address field 20 is aligned with a carbon area 26 for imprinting an outgoing address on the face of the cover ply 31 in the designated area 64. In addition, the return address field 21 is aligned with the carbon area 27 for imprinting a return address in the designated area 35 on the face of the front ply 28.

Referring to FIG. 1 and 2, the "reply address" field 22 is aligned with the carbon area 65 of the cover ply 31 for imprinting of a reply address on the designated area 36 on the front face of the front ply 28.

Referring to FIG. 1, the message area field 23 is aligned with the carbon area 54 on the back of the front ply 28 for imprinting a message on a designated area 52 of the insert ply 30. Likewise, the message area return portion field 24 is aligned with the carbon area 54 on the back of the front ply 28 for imprinting a return message in the designated area 53 of the insert ply 30.

Of note, the fields 20, 22 of the overlying ply 10 may be aligned with the carbon area 54 on the back of the front ply 28 so as to transfer the outgoing address and the reply address onto other designated areas 53, of the insert ply 30. In this case, the insert ply 30 may be provided with a line of weakening 66 so that the insert 30 may be separated into two portions so that a return portion can be returned in the reusable envelope provided by the plies 28, 29. Likewise, the return address field 21 of the overlying ply 10 may be aligned with the carbon area 54 on the back of the front ply 28 to transfer the return address onto a designated area 67 (see FIG. 6) of the insert ply 30.

Further, the mailer unit may be constructed with multiple insert plies, as is known. Also, interdigitated tabs or crimps 68 (FIGS. 2 and 3) in the control strips 12, 32, 55 may be used as a means to hold the overlying ply 10 to the mailer unit 11.

Referring to FIG. 1, a stream of mailer units 11 and web of overlying plies 10 may be fed through suitable automated printing equipment, as is known, for the imprinting of the outgoing address and return and reply addresses on the respective plies along with any suitable message and other information on the insert ply. Thereafter, the overlying ply 10 is removed and the stream of mailer units 11 further processed for mailing purposes for example, including removal of the control strips.

Referring to FIG. 3 and 4, when a mailer unit 11 is placed in the mails, only one mailing address is provided. Thus, there is no risk that the mailer unit 11 would be mailed to the reply address.

Upon receipt, in order to open the mailer unit 11, the recipient would initially remove the removable strips 41', 59 which secure the cover ply 31 to the back ply 29 at the lines of weakening 41, 58.

Figures 5, 6, 7:
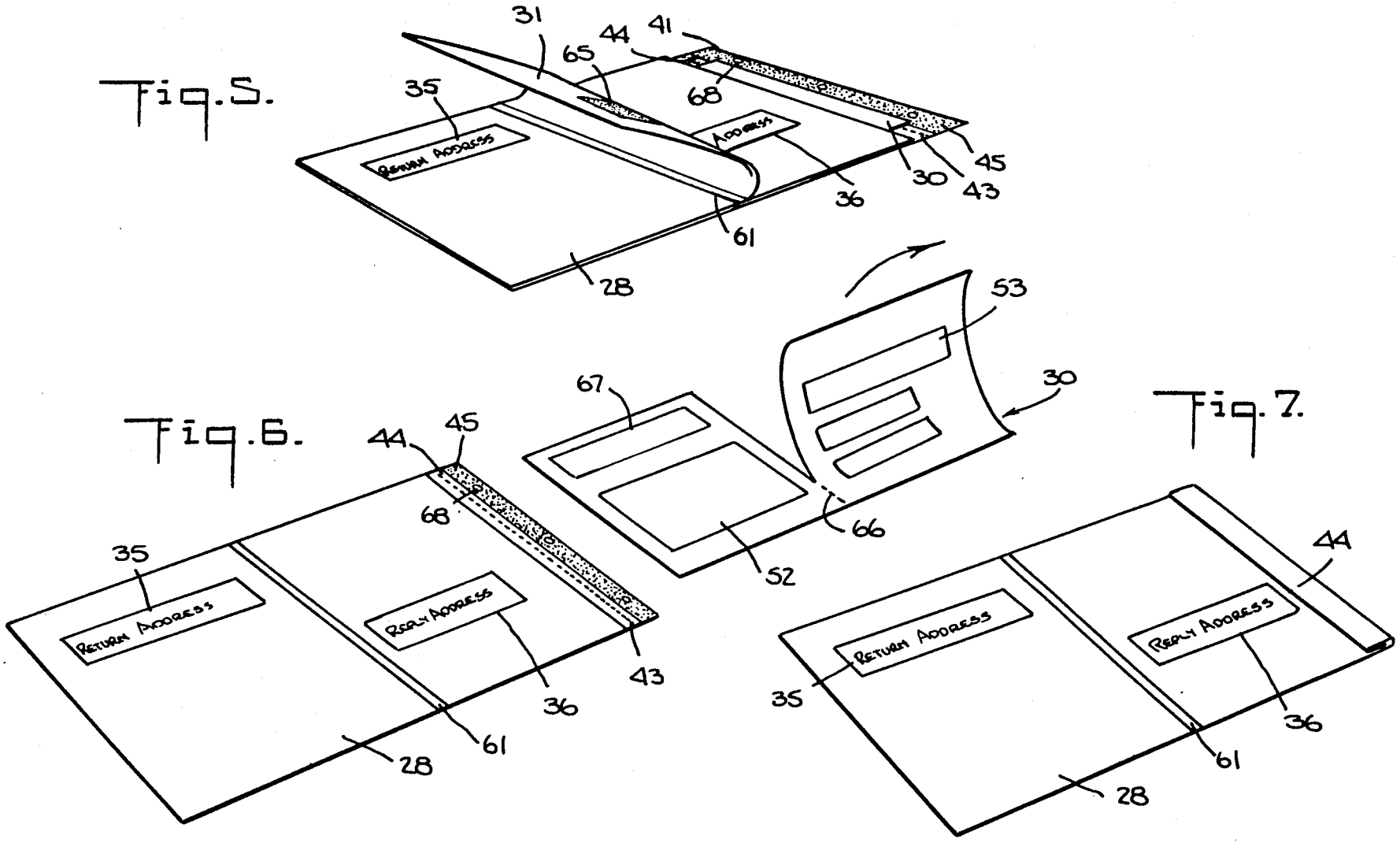
FIG. 5 illustrates a view of a mailer unit during removal of the cover ply in accordance with the invention.
FIG. 6 illustrates a view of the opened mailer unit during removal of an insert ply.
FIG. 7 illustrates a reusable envelope formed by the front and back plies of a mailer unit in accordance with the invention.

Next, as indicated in FIG. 5, the main portion of the cover ply 31 is lifted and peeled to the left, as viewed, and then separated at the left-hand line of perforations 60 (see FIG. 3). At this time, the insert ply 30 is exposed.

Referring to FIG. 6, the insert ply 30 is then removed by the recipient. If a portion of the insert ply 30 is to be returned to the sender, the insert ply 30 is folded or separated along the line of perforation 66 and reinserted between the front and back plies 28 and 29. At this time, as indicated in FIG. 7, the flap 44 of the back ply 29 is folded over and sealed via the glue 45 to the front face of the front ply 28 so as to form a reply mailer. A stamp or other postal indicia is then placed on the reply envelope and the envelope sent back to the sender.

As illustrated in FIG. 7, the front face of the reply mailer has two address areas 35, 36, one of which may be a return address for mailing purposes while the other is a reply address to which information, such as a check, is to be sent. In some cases, the address areas 35, 36 may have the same address.

Referring to FIG. 8 wherein like reference characters indicate like parts as above, the cover ply 31 may be secured to the front ply 28 by a U-shaped pattern of glue dots while being directly secured to the back ply 29 by a line of glue dots. In order to open the envelope, the cover ply is grasped, for example on the left hand side, as viewed, and peeled from the front ply until being peeled off the back ply. The inserts may then be removed as above.

Referring to FIGS. 9 and 10, wherein like reference characters indicate like parts as above, the mailer unit may be constructed with the cover ply 31, extending substantially across the entire width of the mailer unit. As illustrated, the cover ply 31' extends across the width of the front ply 28' and is secured to the front ply 28' by, for example, a line of glue dots along the top and bottom edges. In the illustrated embodiment, the cover ply 31' slightly overlies the front ply 28 on the right-hand side. In this embodiment, the cover ply is not secured to the back ply 29'.

As illustrated, the cover ply 31' has two designated areas 63, 64, one of which is to receive postal indicia while the other is to receive an outgoing address, as above. In addition, the back surface of the cover ply may or may not be provided with a carbon area for imprinting of a reply address on the front ply 28'. Instead, the back surface of the cover ply may be blank while the front ply 28' is provided with preprinted address information and postal indicia.

In use, the cover ply 31, is peeled off the front ply 28' to expose the address on the front ply. The insert or inserts between the front and back plies may then be removed and, after insertion of suitable materials into the resulting reply mailer, the flap 44, of the back ply 29' is then folded over and sealed to the front face of the ply 28. The reply envelope can then be placed in the mails.

The invention thus provides a mailer unit which can be readily sent through the mails without any confusion as to the outgoing address. Further, once received by a recipient, the cover ply containing the outgoing address is removed so that only the reply address is exposed to view.

One advantage of the mailer unit is that the cover ply can be firmly secured to the face of the front ply of the mailer unit. This may be accomplished by any suitable means, such as lines of adhesive, glue spots and the like. Further, since the cover is provided with a carbon area on the back surface, printing of the reply address information on the front information is being printed onto the mailer unit.

What is claimed:

1. A mailer unit comprising a front ply of predetermined width;

a back ply secured to said front ply on three sides thereof to define an open-ended pocket therewith;

at least one removable insert ply within said pocket between said front and back plies;

a cover ply removably secured to said front ply in overlying relation, said cover play having a front surface to receive an outgoing address thereon; and an image transfer means on at least one of said front ply and said cover ply for imprinting of a reply address on said front ply under said cover ply.

2. A mailer unit as set forth in claim 1 wherein said cover ply is secured at one side to said back ply and at an opposing side to an intermediate portion of said front ply.

3. A mailer unit as set forth in claim 2 which further comprises at least one row of glue spots at said opposite side of said cover ply for securing said cover ply to said front ply.

4. A mailer unit as set forth in claim 1 wherein said cover ply has an edge strip adhesively secured to said front ply and a perforation separating said edge strip from the remainder of said cover ply.

5. A mailer unit as set forth in claim 1 wherein said image transfer means is a carbon area on a back side of said cover ply.

6. A mailer unit as set forth in claim 1 wherein said cover ply extends across the entire face of said front ply.

7. A mailer unit comprising a front ply having a preprinted reply address thereon;

a back ply secured to said front ply on three sides thereof to define an open-ended pocket therewith;

at least one removable insert ply within said pocket between said front and back plies; and a cover ply removably secured to said front ply in overlying relation to cover said reply address and removably secured at one end directly to said back ply, said cover play having a front surface to receive an outgoing address and postal indicia thereon.

8. A mailer unit as set forth in claim 7 further comprising an image transfer means on at least one of said plies.

9. A mailer unit as set forth in claim 7 further comprising an image transfer means on one of a back of said front ply and a front of said insert ply for imprinting of information on said insert ply.

10. A mailer assembly comprising an overlying ply of predetermined width having a plurality of data-entry fields on a front surface and a plurality of image transfer means on a back surface aligned with selected data-entry fields;

a mailer unit including a first ply with at least one area underlying one of said image transfer areas of said overlying ply to receive imprinted information thereon an having an image transfer area on a back surface aligned with a data-entry field of said overlying ply, a second ply underlying said first ply and removably secured to at least one side of said first ply, said second ply including an area underlying one of said image transfer means of said overlying ply to receive imprinted information thereon and an image transfer means on a back surface aligned with at least some of said data-entry fields, a third ply having a portion underlying said second ply with an area underlying said image transfer means of said second ply to receive imprinted information thereon, and a fourth ply of a width equal to said overlying ply underlying and secured to said second ply to define an open-ended pocket receiving said third ply therein, said fourth ply being removably secured to a second side of said first ply; and means releasably securing said overlying ply to said mailer unit.

11. A mailer assembly as set forth in claim 10 wherein said third ply is of greater width than said second ply and of less width than said fourth ply and wherein said second and fourth plies are secured to each other along transverse edges to contain said third ply therebetween.

12. A mailer assembly as set forth in claim 10 wherein said fourth ply has a flap portion for folding over said second ply to define an enclosed pocket therewith for a reply mailer, said flap having adhesive thereon to seal against said second ply.

13. A mailer as set forth in claim 10 wherein said data-entry fields include a "postal indicia" field aligned wit a respective image transfer means of said overlying ply for imprinting postal information onto said first ply; an "outgoing address" field aligned with a respective image transfer means for imprinting an outgoing address on said first ply and a "return address" field aligned with a respective image transfer means for imprinting a return address on said second ply.

14. A mailer as set forth in claim 13 wherein said data-entry fields include a "reply address" field aligned with said image transfer means of said first ply for imprinting of a reply address on said second ply.

15. A mailer as set forth in claim 14 wherein said data-entry fields include a "message area" field aligned with said image transfer means of said second ply for imprinting a message on said third ply and a "message area return portion" field aligned with said image transfer means of said second ply for imprinting a return message on said third ply.

16. A mailer as set forth in claim 10 which further includes pairs of pin hole control strips secured to opposite sides of each of said first ply and said mailer unit and interdigitaled tabs in overlying control strips for holding said strips together.

17. A mailer unit as set forth in claim 7 which further comprises a line of glue dots removably securing said cover ply to said back ply.

* * * * *

UNITED STATES PATENT AND TRADEMARK OFFICE

CERTIFICATE OF CORRECTION

PATENT NO. : 5,011,069

DATED : April 30, 1991

INVENTOR(S) : Charles G. Bowen

It is certified that error appears in the above-identified patent and that said Letters Patent is hereby corrected as shown below:

Column 3, line 5 "or" should be -of-
Column 5, line 64 "1924" should be -19-
Column 6, line 4 "area" should be -areas-
Column 6, line 22 "53" should be -53'-
Column 7 , line 18 "31" should be -31'-
Column 7, line 37 "31" should be -31'-
Column 7, line 57 after "front" insert --ply of the mailer unit can be performed while all the other--
Column 8, line 48 "an" should be -and-

Signed and Sealed this

First Day of December, 1992

*Attest:*

*Attesting Officer*

DOUGLAS B. COMER

*Acting Commissioner of Patents and Trademarks*